US006302791B1

(12) United States Patent
Frohm et al.

(10) Patent No.: US 6,302,791 B1
(45) Date of Patent: Oct. 16, 2001

(54) GAMING MACHINE WITH HIGH VOLATILITY INDEX

(75) Inventors: Erica A. Frohm, Evanston, IL (US); John J. Giobbi, Crown Point, IN (US)

(73) Assignee: WMS Gaming Inc., Chicago, IL (US)

( * ) Notice: Subject to any disclaimer, the term of this patent is extended or adjusted under 35 U.S.C. 154(b) by 0 days.

(21) Appl. No.: 09/500,857

(22) Filed: Feb. 9, 2000

(51) Int. Cl.[7] ..... A63F 9/22

(52) U.S. Cl. ..... 463/21; 463/20; 463/22; 463/16; 463/17; 273/143 R

(58) Field of Search ..... 463/16–22

(56) References Cited

U.S. PATENT DOCUMENTS

| | | | | |
|---|---|---|---|---|
| 4,991,848 | | 2/1991 | Greenwood et al. | 273/143 |
| 5,393,067 | | 2/1995 | Paulsen et al. | 273/292 |
| 5,720,662 | * | 2/1998 | Holmes, Jr. et al. | 463/20 |
| 5,788,573 | | 8/1998 | Baerlocher et al. | 463/16 |
| 5,833,538 | * | 11/1998 | Weiss | 463/21 |
| 5,879,234 | * | 9/1999 | Mengual | 463/20 |
| 5,888,136 | * | 3/1999 | Herbert | 463/22 |
| 6,068,552 | * | 5/2000 | Walker et al. | 463/21 |

OTHER PUBLICATIONS

Product Sheet for Monopoly ® Roll & Win™, WMS Gaming Inc., 2 pages (1998).

Product Sheet for Monopoly® Movers & Shakers™, WMS Gaming Inc., 2 pages (2000).

Product Sheet for Monopoly ® Once Around™, WMS Gaming Inc., 2 pages (1998).

Product Sheet for Monopoly® Chairman of the Board™Wild, WMS Gaming Inc., 2 pages (1999).

Product Sheet for Monopoly® Chairman of the Board™, WMS Gaming Inc., 2 pages (1999).

Product Sheet for Monopoly® Advance to Boardwalk®, WMS Gaming Inc., 2 pages (1999).

Product Sheet for Jackpot Stampede Deluxe™, WMS Gaming Inc., 2 pages (1999).

Product Sheet for Jackpot Country Party™, WMS Gaming Inc., 2 pages (1998).

Product Sheet for Stroke of Luck™, WMS Gaming Inc., 2 pages (1998).

Product Sheet for Jackpot Beach Party™, WMS Gaming Inc., 2 pages (1998).

Product Sheet for Perfect Match™, WMS Gaming Inc., 2 pages (1999).

Product Sheet for Mermaid's Gold™, WMS Gaming Inc., 2 pages (1997).

Product Sheet for Magic Lamp™, WMS Gaming Inc., 2 pages (1997).

Product Sheet for Winning Streak™, WMS Gaming Inc., 2 pages (1997).

Product Sheet for Top Cat™, WMS Gaming Inc., 2 pages (1997).

Product Sheet for X–Factor™, WMS Gaming Inc., 2 pages (1997).

Product Sheet for Pharaoh's Fortune™, WMS Gamina Inc., 2 pages (1997).

Product Sheet for Riverbelle 21™, WMS Gaming Inc., 2 pages (1998).

(List continued on next page.)

*Primary Examiner*—Jessica J. Harrison
*Assistant Examiner*—Carmen D. White
(74) *Attorney, Agent, or Firm*—Jenkens & Gilchrist

(57) ABSTRACT

A gaming machine comprises a spinning reel display showing a plurality of symbols on each of a plurality of rotatable reels. The reels are rotated and stopped to place the symbols of each reel in visual association with a pay line. A winning combination of displayed symbols triggers a payoff. The distribution of payoff values and probabilities results in a high volatility index, so that the distribution is similar to a state-run lottery.

24 Claims, 6 Drawing Sheets

OTHER PUBLICATIONS

Product Sheet for Top Cat Deluxe™, WMS Gaming Inc., 2 pages (1998).
Product Sheet for Jackpot Party™, WMS Gaming Inc., 2 pages (1998).
Product Sheet for Reel'Em in!™, WMS Gaming Inc., 2 pages (1997).
Product Sheet for Filthy Rich™, WMS Gaming Inc., 2 pages (1998).
Product Sheet for Jackpot Party Video™, WMS Gaming Inc., 2 pages (1999).
Product Sheet for Something for Nothing™, WMS Gaming Inc., 2 pages (2000).
Product Sheet for Who Dunnit™, WMS Gaming Inc., 2 pages (1999).
Product Sheet for Winning Bid™, WMS Gaming Inc., 2 pages (1999).
Product Sheet for Money to Burn™, WMS Gaming Inc., 2 pages (2000).
Product Sheet for Cast for Cash™, WMS Gaming Inc., 4 pages (1999).
Product Sheet for Swingin' in the Green™, WMS Gaming Inc., 2 pages (2000).
Product Sheet for Perfect Game™, WMS Gaming Inc., 2 pages (2000).
Product Sheet for Cash Crop™, WMS Gaming Inc., 2 pages (2000).
Prodcut Sheet for Wild Streak™, WMS Gaming Inc., 2 pages (2000).
Product Sheet for Yukon Gold™, WMS Gaming Inc., 2 pages (2000).

* cited by examiner

| Wager Amount | Payoff | Probability | Plays/Hit | Expected Value of $3 Play | Volatility Index |
|---|---|---|---|---|---|
| $3 | $1,000,000 | 0.000002721653 | 367,423 | $2.72 | 1417 |

*Fig. 4a*

| Wager Amount | Payoff | Probability | Plays/Hit | Expected Value of $3 Play | Volatility Index |
|---|---|---|---|---|---|
| $3 | $1,000,000 | 0.00000265 | 377,358 | $2.65 | 1399 |

*Fig. 4b*

| Wager Amount | Payoff | Probability | Plays/Hit | Expected Value of $1 Play | Volatility Index |
|---|---|---|---|---|---|
| $1 | $1,000,000 | 0.00000046 | 2,173,913 | $0.46 | 2143 |
| | $500,000 | 0.00000092 | 1,086,957 | $0.46 | |
| | | | Total Expected Value: | $0.92 | |

*Fig. 4c*

| Wager Amount | Payoff | Probability | Plays/Hit | Expected Value of $1 Play | Volatility Index |
|---|---|---|---|---|---|
| $1 | $10,000 | 0.000023 | 43,478 | $0.23 | 150 |
| | $3,000 | 0.000077 | 13,043 | $0.23 | |
| | $1500 | 0.000153 | 6522 | $0.23 | |
| | $200 | 0.00115 | 870 | $0.23 | |
| | | | Total Expected Value: | $0.92 | |

*Fig. 4d*

| Wager Amount | Payoff | Probability | Plays/Hit | Expected Value of $3 Play | Volatility Index |
|---|---|---|---|---|---|
| $3 | $1,000,000 | 0.00000099 | 1,010,101 | $0.99 | 884 |
| | $100,000 | 0.000006 | 166,667 | $0.60 | |
| | $10,000 | 0.00006 | 16,667 | $0.60 | |
| | $100 | 0.006 | 167 | $0.60 | |
| | | | Total Expected Value: | $2.79 | |

*Fig. 4e*

GAMING MACHINE WITH HIGH VOLATILITY INDEX

FIELD OF THE INVENTION

The present invention relates generally to gaming machines and, more particularly, to a gaming machine with a high volatility index, i.e., most of the payoffs provided by the machine are high, and these high payoffs have a fairly high probability of occurring.

BACKGROUND OF THE INVENTION

Gaming machines such as slot machines determine the value of a player's payoff by the orientation of symbols on a display. In a typical slot machine, there are numerous payoff values each with a predetermined probability of payoff based on a variety of possible symbol orientations. The attractiveness of a slot machine to a player is based on many factors, including appearance, entertainment value, and the values and perceived chances of winning payoffs. Attempting to attract players, most slot machines currently in use employ numerous payoff levels spread fairly evenly along a spectrum from the lowest possible payoff (often simply a return of the player's bet) to the highest payoff. Slot machines have proven immensely popular with players, and casino operators typically install dozens to hundreds of the machines in a single casino.

The industry standard for measuring distribution of sizes and probabilities of slot machine payoffs is a mathematical value called the volatility index. Current slot machines all have low volatility indices, which means that there is a relatively steady progression of many payoff values from the lowest to the highest, with each payoff's corresponding probability decreasing as the value of the payoff increases.

State-run lotteries, like slot machines, are seeing great popularity. Lotteries are based on the chances of a player's chosen series of numbers matching a randomly selected series. In a lottery, there may be several smaller payoff levels based on combinations of a few numbers, but the largest payoff is reserved for the very small number of players who match all numbers. Expressed in terms used to describe slot machines, lotteries therefore have a high volatility index, though lotteries' volatility indices will not necessarily be as high as the volatility indices of the present invention because large payoffs have an extremely small chance of occurring. The popularity of a lottery is directly linked to the size of the maximum payoff, so that a high maximum payoff will result in more lottery tickets being sold, even though the chances of winning remain extremely small. Players' appreciation of lotteries stems from the fact that incredible wealth can be achieved with a single play.

Because both slot machines and lotteries are extremely popular, a slot machine employing the general payoff characteristics of a lottery would make use of each game's individual popularity to appeal to both players and casino operators. Further, the odds of winning large payoffs on a slot machine need not be so remote as in a lottery, and greater odds of winning will result in more visible large wins in a casino, increasing player interest in the slot machine. Thus, there is a need to develop a slot machine that retains the easy playability and attractive design of a slot machine, and combines this with the high volatility index seen in lotteries. The present invention is directed to satisfying this need.

SUMMARY OF THE INVENTION

In accordance with one aspect of the present invention, there is provided a payoff distribution for a slot machine with game outcomes characterized by a high volatility index. The slot machine includes a spinning reel display showing a plurality of symbols on each of a plurality of rotatable reels. The reels are rotated and stopped to place the symbols of each reel in visual association with a pay line. The pay line is associated with at least one of the stops on each of the reels. In one embodiment, the reels are rotatable about a single vertical axis so that the pay line is oriented in a vertical direction. In this embodiment, each reel is capable of displaying only one payoff symbol, though this symbol may appear several times on each reel. The machine of this embodiment only has one possible high payoff of, for example, one million U.S. dollars. The payoff of this embodiment is granted when each reel displays one of its payoff symbols so that the symbols align vertically with the pay line.

BRIEF DESCRIPTION OF THE DRAWINGS

The foregoing and other advantages of the invention will become apparent upon reading the following detailed description and upon reference to the drawings in which:

FIGS. 4*a*, 4*b*, 4*c*, 4*d*, and 4*e* are math tables identifying payoff amounts and probabilities that may occur in five embodiments of the invention.

Figure 1:
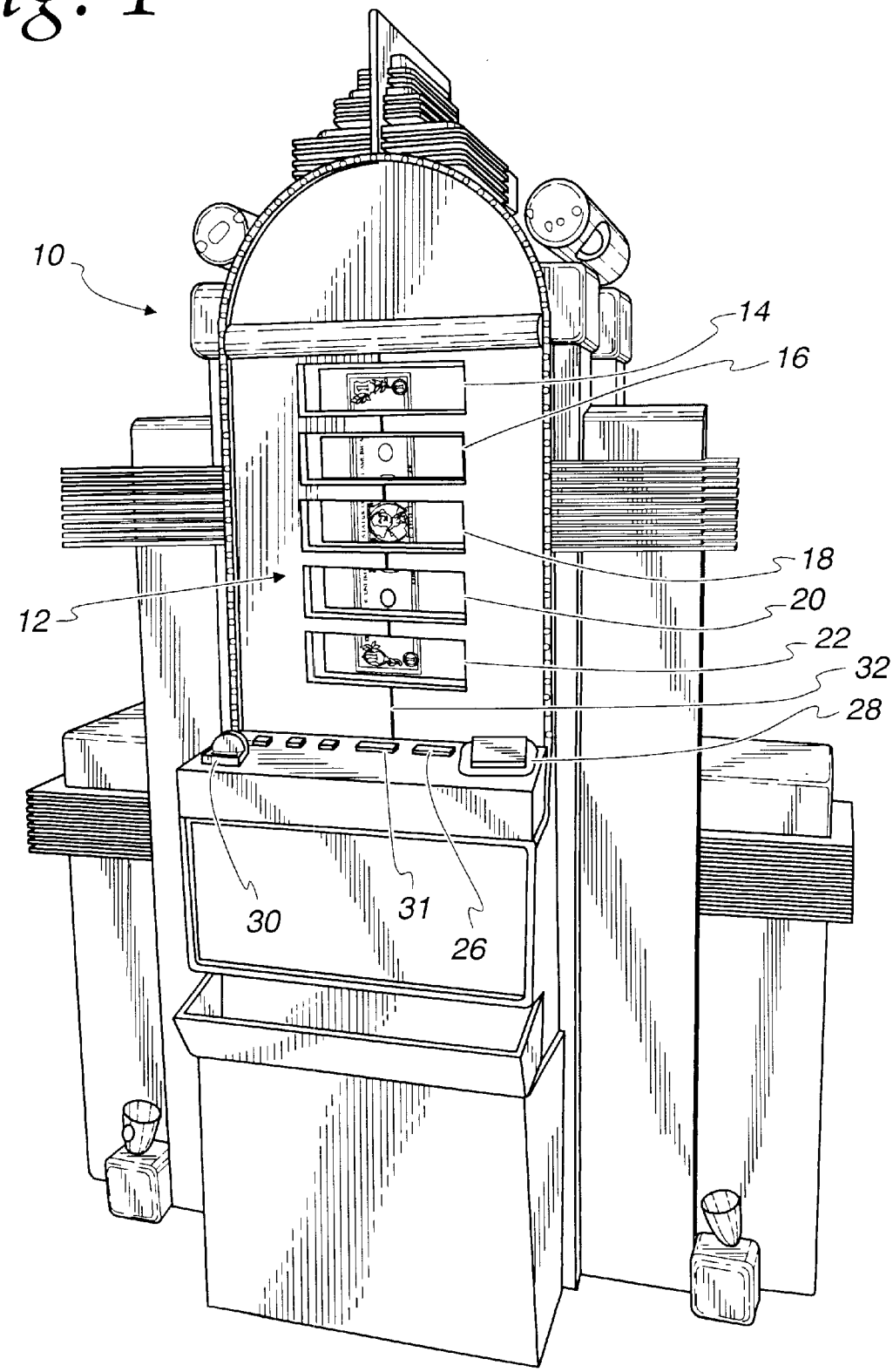
FIG. 1 is a perspective view of a gaming machine embodying the invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

Though gaming machines have seen great popularity in casinos, up to this point they have all utilized fairly limited ranges of payoffs and probabilities. Current gaming machines have long lists of payoffs, with the probabilities gradually getting smaller for higher payoffs in the distribution. For example, a typical casino gaming machine might have ten payoff levels ranging from a few U.S. dollars to several thousand U.S. dollars, with a roughly linear progression for the intermediate values. This distribution is different from the payoff and probability distributions seen in popular state-run lotteries, where the values of the largest payoffs are much greater than smaller payoffs, with corresponding much smaller odds of winning the largest payoffs. If casino players are given the option to play gaming machines having payoff distributions similar to state-run lotteries, it is believed that such gaming machines, along with the casinos that feature them, will see great success given the combined popularity of gaming machines and state-run lotteries. While most gaming machines currently in use feature relatively low volatility indices of from 5 to 100, a gaming machine having a volatility index greater than or equal to about 150 will maintain the excitement of high payoffs being attainable within a reasonable number of spins.

The present invention is directed to producing a gaming machine that will make use of this combined interest in lotteries and standard casino gaming machines. FIG. 1 shows a slot machine 10 on which the present invention may be implemented. The slot machine 10 includes a display area 12 through which a player may observe five mechanical reels 14, 16, 18, 20, and 22. It will be appreciated that the game may alternatively be implemented entirely on a video display that shows video images of reels, and it may also be implemented on a display that includes more or fewer reels.

Figure 2:
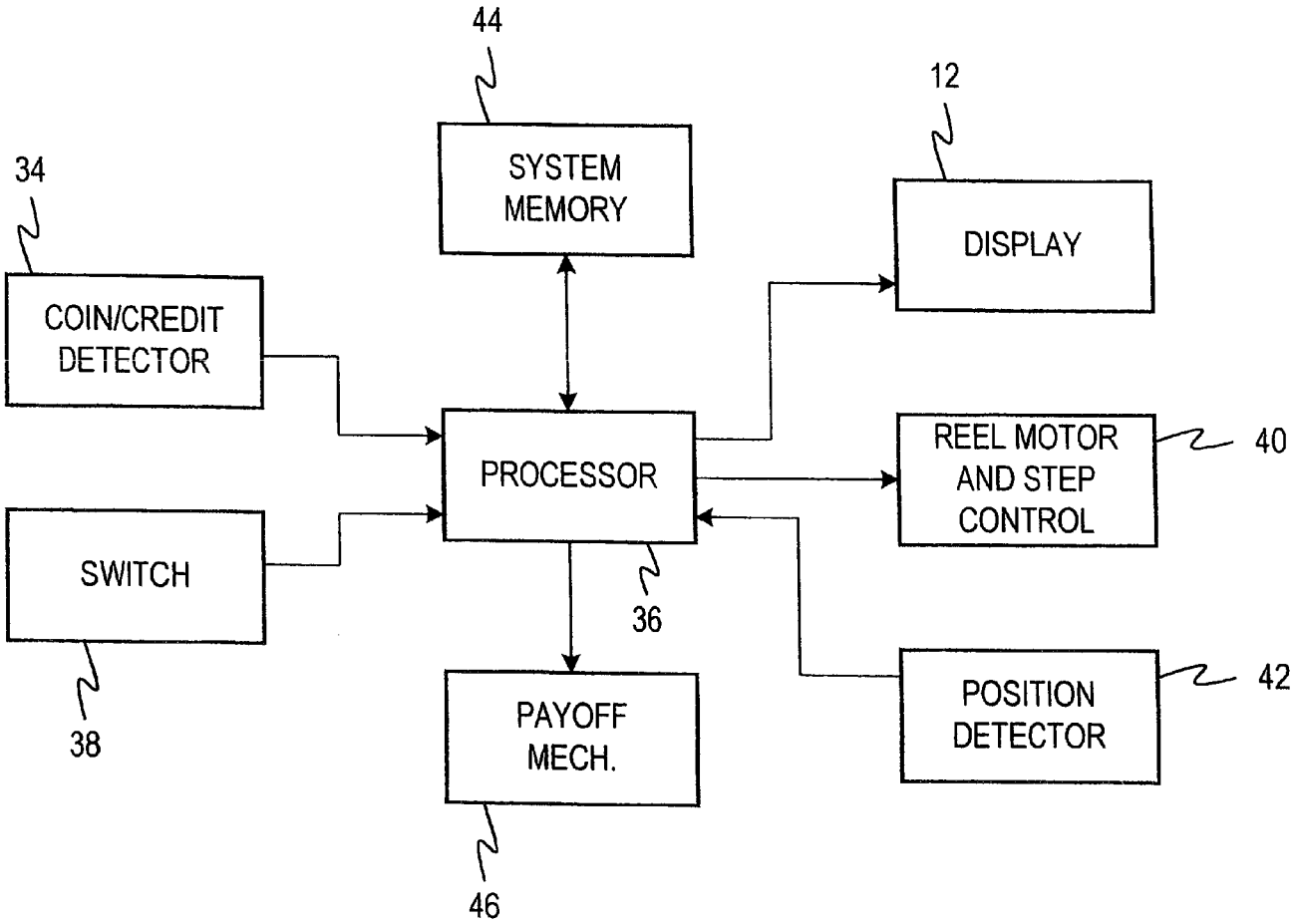
FIG. 2 is a block diagram of a control system suitable for controlling the gaming machine in FIG. 1.

FIG. 2 is a block diagram of a controller system suitable for operating the slot machine 10 of FIG. 1. A coin/credit detector 34 signals a processor 36 when a player has inserted a number of coins into a coin slot 30 (see FIG. 1), inserted bills into a bill acceptor 28 (see FIG. 1) or played a number of credits by using the "bet" button 31. After the player has activated a switch 38 (e.g., by pushing a spin button 26), the processor 36 initiates game play by randomly selecting stop positions for the reels 14, 16, 18, 20, and 22 (see FIG. 1) and setting the reels 14, 16, 18, 20, and 22 in motion. Then, using technology well known in the art, the processor 36 causes a reel motor and step control 40 to successively stop the reels 14, 16, 18, 20, and 22 at the selected stop positions, starting with the bottom reel 22 and progressing to the top reel 14. A rotational position detector 42 provides feedback to the processor 36 to ensure that the reels 14, 16, 18, 20, and 22 are stopped at the correct stop positions. The symbols displayed on the reels at the stop positions define the game outcome.

A system memory 44 stores control software, operational instructions, and data associated with the slot machine 10. In one embodiment, the system memory 44 comprises a separate read-only memory (ROM) and battery-backed random-access memory (RAM). However, it will be appreciated that the system memory 44 may be implemented on any of several alternative types of memory structures or may be implemented on a single memory structure. A payoff mechanism 46 is operable in response to instructions from the processor to grant a payoff of coins or credits to the player in response to the winning combination stored in memory 44. This embodiment is programmed to contain only one winning combination, but other embodiments of this gaming machine having several possible winning combinations are contemplated.

As best observed in FIG. 1, the symbols on the reels 14, 16, 18, 20, and 22 are displayed in a symbol group consisting of five symbols, with each displayed symbol aligned with a vertical pay line 32. Under this embodiment, at most one non-blank symbol per reel is visible when the reels 14, 16, 18, 20, and 22 are stopped, but it will be appreciated that alternative embodiments could be created wherein several non-blank symbols on each reel would be visible at once. The symbol group is determined to include the winning combination (e.g., the symbol combination resulting in a payment of coins or credits) if it includes the combination of symbols which corresponds to the predefined winning combination. The predefined winning combination and its associated payoff amount for the game are stored in the system memory 44 and may also be shown on a pay table printed on the slot machine cabinet.

Under this embodiment, the symbols on the reels 14, 16, 18, 20, and 22 comprise blank spaces and portions of a fictional $1 million U.S. dollar bill. Only one winning combination exists, and it is displayed graphically when all portions of the $1 million U.S. dollar bill align along the single pay line 32. Other embodiments could be developed using the present invention. For example, a gaming device similar to the first embodiment could have several payoffs instead of only one, with the distribution of probabilities and payoffs still having a high volatility index. As another example, the gaming machine could play keno, bingo, or roulette instead of slots. Another possible embodiment of the present invention is a gaming machine accepting several different wager amounts, with different volatility indices for each wager amount. All embodiments of the invention are such that the distribution of payoff probabilities and values as stored in system memory 44 exhibits a high volatility index, VI, for at least one wager amount.

The volatility index for a machine accepting multiple wager amounts is defined as:

$$VI = \frac{CL_F \sum_{w=1}^{WAGER} \sqrt{\sum_{k=1}^{N} P_{win\,k}\left(\frac{Pay_{scaled\,k}}{Bet_{scaled_w}} - \frac{EV_w}{100}\right)^2}}{WAGER}$$

where:

$CL_F$ is a confidence level factor, described below (for example, $CL_F$=2.58 for a confidence interval of 99–100% and $CL_F$=1.65 for a confidence interval of 90–100%);

w progresses from one to the number of the maximum wager (i.e., if five different wagers are possible, w progresses from 1 to 5);

k progresses from one to the number of payoffs;

N is the number of different payoffs;

$P_{win\,k}$ is the probability of a specified payoff occurring;

$Pay_{Scaled\,k}$ is a scaled payoff (i.e., the payoff divided by the amount of money wagered) corresponding to each payoff, $Bet_{scaled\,w}$ is a scaled wager amount where magnitudes of wagers have been uniformly re-scaled so that the largest is 1 (hence, bets of 1,5 and 100 can give scaled wager amounts of 1/100,1/20and 1);

$EV_W$, is the expected value of the return percentage, defined to be the percentage of the total wager that the machine will pay out over the cycle of the game, where the cycle is defined to be the set of all possible outcomes; and WAGER is the maximum number of possible wagers, where different wagers alter the ratios of payoffs to bets or the probabilities associated with one or more payoffs.

In the present invention, at least one wager results in a high volatility index. For an embodiment having only one possible wager and several possible payoffs, the volatility index equation is simplified to:

$$VI = CL_F \sqrt{\sum_{k=1}^{N} P_{win\,k}\left(Pay_{scaled_k} - \frac{EV}{100}\right)^2}$$

where $CL_F$ is the confidence interval factor, described below;

k progresses from one to the number of payoffs;

N is the number of different payoffs;

$P_{win\,k}$ is the probability of a win with one play;

$Pay_{scaled\,k}$ is a scaled payoff (i.e., the payoff divided by the amount of money wagered) corresponding to each payoff; and EV is the expected value of the return percentage, defined to be the percentage of the total wager that the machine will pay out over the cycle of the game, where the cycle is defined to be the set of all possible outcomes.

This simplified equation can be used to calculate the volatility index experienced by a player for a certain wager, even on a machine having multiple wagers. The expected value, scaled payoff, probability of winning, and number of different payoffs may change with each specific wager, and these values can be input into the simplified equation to give a volatility index experienced by a player for a specific wager. The present invention may be implemented on a game having multiple possible wagers, even when only one wager results in a high volatility index.

The confidence level is a statistical term used in the gaming industry to denote the probability that the average game outcome will occur within a predefined range, called the confidence interval, of the expected outcome for a given number of total plays. Hence, for a fixed volatility index and a given number of total plays, choosing a smaller confidence interval (e.g., 99–100% rather than 99–100%) gives a smaller confidence level. For a fixed confidence interval and a given number of total plays, a game with a higher volatility index will have a lower confidence level, since the volatility index is basically a measure of the variability of return on a given number of coins. For a game with a high volatility index to achieve the same confidence level for a given confidence interval as a game with a lower volatility index, one needs additional plays.

Figure 3A:
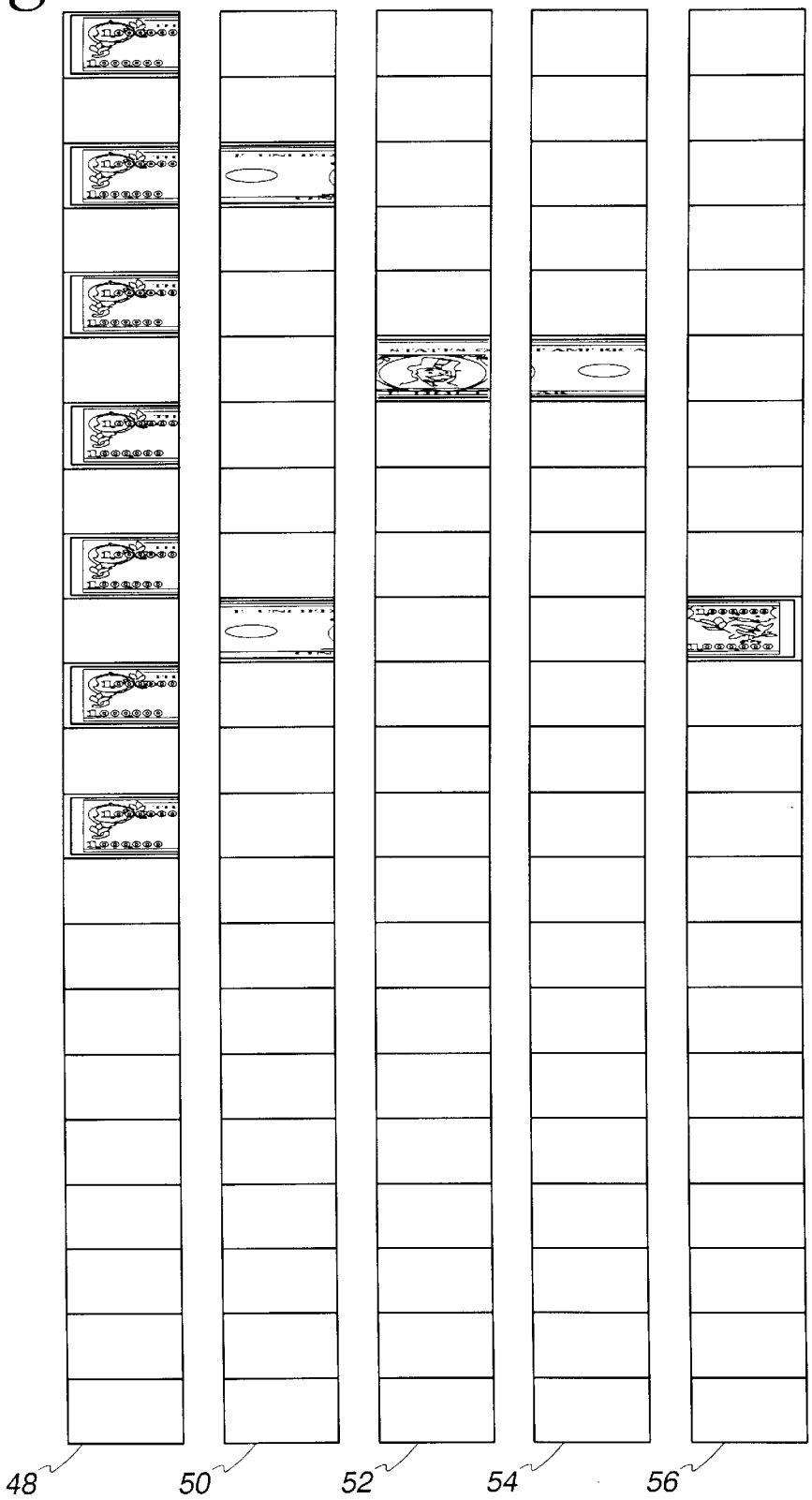
FIGS. 3*a* and 3*b* are diagrams of reel strips used in two embodiments of the present invention.
Figure 3B:
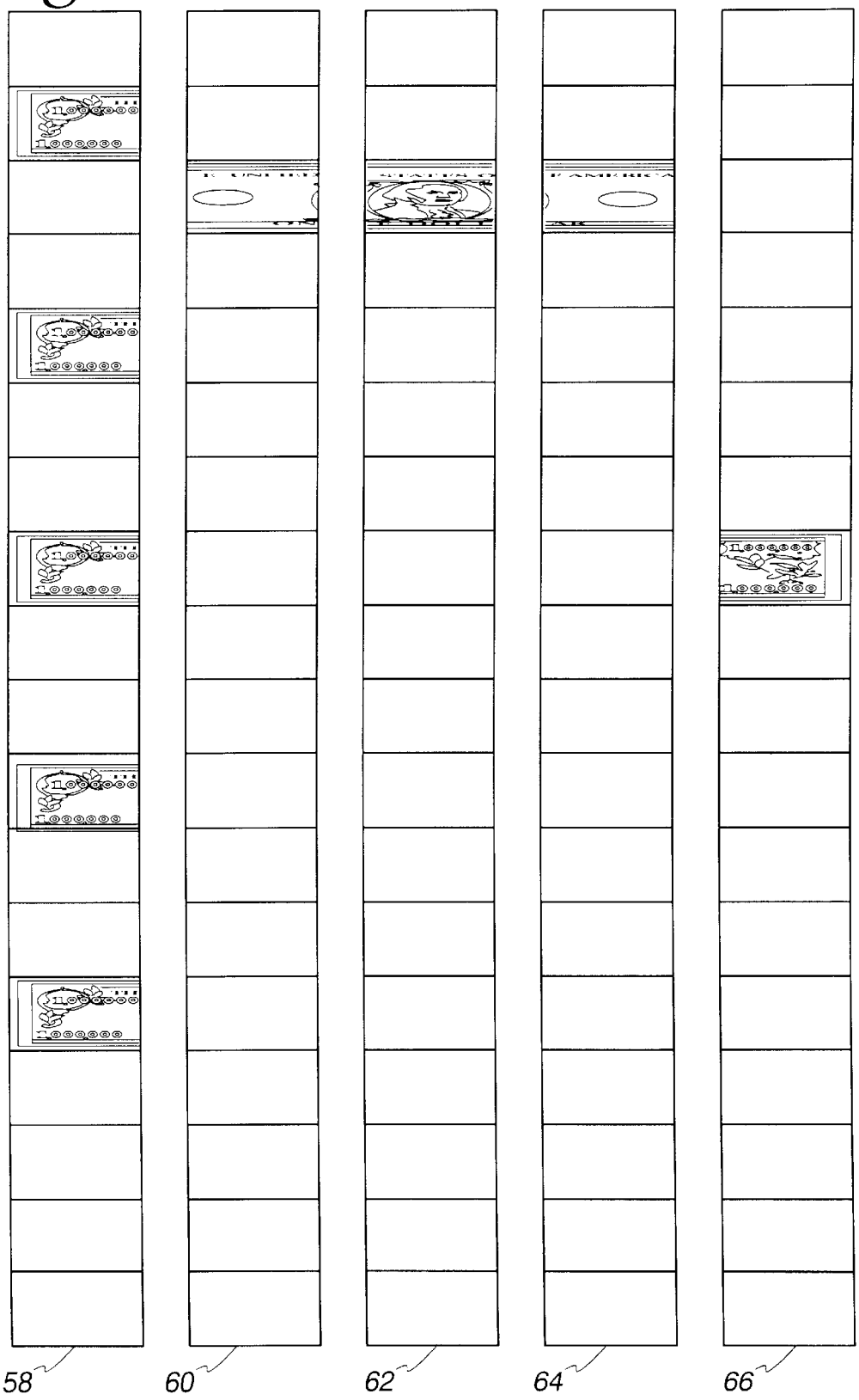

FIGS. 3*a* and 3*b* depict reel strips to be used in two embodiments of the present invention. A reel strip is a strip containing the symbols for a mechanical slot machine, and the strips are wrapped around the reels that display the game outcome. FIG. 3*a*, corresponding to a first embodiment of the invention, shows a set of five reel strips 48, 50, 52, 54, and 56, with each strip having 22 possible stopping positions that could be displayed in the display area 12. To achieve the desired win probability for this embodiment, one reel trip 48 contains seven payoff symbols that are included in the winning combination, a second reel strip 50 contains two payoff symbols that are included in the winning combination, and each of the third, fourth, and fifth reel strips 52, 54, and 56 contains one payoff symbol included in the winning combination.

FIG. 3*b*, corresponding to a second embodiment of the invention, shows a set of five reel strips 58, 60, 62, 64, and 66, with each strip having 18 possible stopping positions that could be displayed in the display area 12. Reel strip 58 contains five payoff symbols that are included in the winning combination, and each of reel strips 60, 62, 64, and 66 contains one payoff symbol that is included in the winning combination.

FIG. 4*a* shows a math table corresponding to the first embodiment having only one possible payoff and five reel strips with 22 positions on each strip. The "Wager Amount" column indicates the amount of money that the player bets with each play. The "Payoff" column identifies the pay value of the sole winning outcome. The "Probability" column indicates the probability of hitting the respective winning combination in a single spin. This number is the same as the "hit frequency" in the volatility index equations. The "Plays/Hit" column identifies, on average, the number of plays that would be required to "hit" the game's winning symbol combination. This value is the inverse of the probability. For example, in a game having the reel strips shown in FIG. 3*a*, the probability of hitting the winning combination in a single pull is 0.00000272. The plays/hit value is thus $1/0.00000272$, or approximately 367,423. In this first embodiment, it would take approximately 367,423 plays, on average, to hit the winning combination.

The "Expected Value of $3 Play" column of FIG. 4*a* identifies the expected value of each play of the first embodiment, which is computed by finding the product of the "Payoff" value and the "Probability" value. Thus, for the first embodiment with reel strips as shown in FIG. 3*a* having a payoff of $1,000,000, a wager amount of $3, and a probability of 0.00000272, the "expected value" of each $3 play is computed as: $1,000,000×0.00000272=$2.72. The "Volatility Index" column gives the volatility index for this embodiment with a confidence interval of 99–100%.

The volatility index for the machine of this embodiment is calculated according to the simplified equation, above. The probability of a win, $P_{win}$, is 2.71653E-06. The scaled payoff, $Pay_{scaled}$, is $1,000,000 divided by the wager amount, $3, or 333,333.33. The expected value percentage, EV, is thus the scaled payoff multiplied by the probability of a win, or 333,333.33×2.71653E-06=0.9055, or 90.55% of the money wagered. Hence, using the volatility index equation given above for games having one wager amount, the volatility index for the embodiment shown in FIG. 4*a*, VI, is calculated as:

$$VI = 2.58\sqrt{0.00000271653(333{,}333.33 - .9055)^2} \approx 1417.$$

FIG. 4*b* shows a math table corresponding to a second embodiment having only one possible payoff and five reel strips with 18 positions on each strip. Each column in FIG. 4*b* contains the same information depicted in the corresponding column in FIG. 4*a*, with the values being slightly modified because this embodiment has a different reel strip configuration. In a game having the reel strips shown in FIG. 3*b*, the probability of hitting the winning combination in a single pull is 0.00000265. The plays/hit value is thus $1/0.00000265$, or approximately 377,358. In this second embodiment, it would take approximately 377,358 plays, on average, to hit the winning combination. Further, for the second embodiment with reel strips as shown in FIG. 3*b* having a pay value of $1,000,000, a wager amount of $3, and a probability of 0.00000265, the expected value of each $3 play is computed: $1,000,000×0.00000265=$2.65. The volatility index is given for a confidence interval of 99–100%.

FIG. 4*c* is a math table for a third embodiment having multiple payoff possibilities with a single wager. Each column contains the information explained above for each payoff. The two expected values are added to arrive at the "Total Expected Value" as shown in the bottom row.

FIG. 4*d* is a math table for a fourth embodiment having multiple payoff possibilities with a single wager. The mathematical basis for this table is described above.

FIG. 4*e* is a math table for a fifth embodiment of the present invention, having multiple payoffs with a maximum payoff of $1 million and a volatility index of approximately 884.

While the present invention has been described with reference to one or more preferred embodiments, those skilled in the art will recognize that many changes may be made thereto without departing from the spirit and scope of the present invention which is set forth in the following claims.

What is claimed is:

1. A gaming machine comprising:

a spinning reel display having a plurality of symbols on each of a plurality of rotatable reels, said reels being rotated and stopped at stop positions to place combinations of said symbols in visible association with a pay line; and a controller randomly determining said stop positions of said reels based on a probability of hitting any payoff-generating one of the combinations of less than 5 percent and based on a volatility index greater than or equal to about 150 for a confidence interval of 99 percent.

2. The gaming machine of claim 1 wherein said spinning reel display includes a video screen showing video images of said reels.

3. The gaming machine of claim 1 wherein said reels are mechanical and said spinning reel display includes a window through which said plurality of symbols on each of said mechanical reels is viewed.

4. The gaming machine of claim 3 wherein said reels are rotatable about a vertical axis.

5. The gaming machine of claim 3 wherein said reels are rotatable about a horizontal axis.

6. The gaming machine of claim 1 wherein there is only one possible payoff.

7. The gaming machine of claim 1 wherein said volatility index is greater than or equal to about 1500.

8. The gaming machine of claim 1 wherein said symbols include only blanks and payoff symbols.

9. The gaming machine of claim 1 wherein only one wager amount is allowed.

10. A high volatility index payoff method for a gaming machine, the method comprising:

providing a game of chance selected from a group consisting of slots, bingo, keno, and roulette, said game having outcomes, randomly determined based on a probability of hitting any payoff-generating one of the outcomes of less than 5 percent and based on a volatility index greater than or equal to about 150 for a confidence interval of 99 percent;

playing said game in response to a wager placed by a player;

generating one of said outcomes; and providing the player with a payoff for hitting said any payoff-generating one of said outcomes.

11. A gaming machine, comprising a game of chance controlled by a controller in response to a wager, said game of chance being selected from a group consisting of slots, bingo, keno, and roulette, said game having outcomes randomly determined based on a probability of hitting any payoff-generating one of the outcomes of less than 5 percent and based on a volatility index greater than or equal to about 150 for a confidence interval of 99 percent.

12. The gaming machine of claim 10 wherein said game of chance is displayed via a spinning reel display including a video screen showing video images of said reels.

13. The gaming machine of claim 10 wherein said game of chance is displayed via a spinning reel display including mechanical reels and a window through which a plurality of symbols on each of said mechanical reels are viewed.

14. The gaming machine of claim 13 wherein said reels are rotatable about a vertical axis.

15. The gaming machine of claim 13 wherein said reels are rotatable about a horizontal axis.

16. The gaming machine of claim 13 wherein there is only one possible payoff.

17. The gaming machine of claim 13 wherein said volatility index is greater than or equal to about 1500.

18. A gaming machine, comprising a game of chance controlled by a controller in response to one or more wager amounts, said game of chance being selected from a group consisting of slots, bingo, keno, and roulette, said game having randomly determined outcomes for each of said wager amounts, wherein for at least one of said wager amounts said outcomes are randomly determined based on a probability of hitting any payoff-generating one of the outcomes of less than 5 percent and based on a volatility index greater than or equal to about 150 for a confidence interval of 99 percent.

19. The gaming machine of claim 18 wherein said game of chance is displayed via a spinning reel display including a video screen showing video images of said reels.

20. The gaming machine of claim 18 wherein said game of chance is displayed via a spinning reel display including mechanical reels and a window through which a plurality of symbols on each of said mechanical reels are viewed.

21. The gaming machine of claim 20 wherein said reels are rotatable about a vertical axis.

22. The gaming machine of claim 20 wherein said reels are rotatable about a horizontal axis.

23. The gaming machine of claim 20 wherein there is only one possible payoff.

24. The gaming machine of claim 20 wherein said volatility index is greater than or equal to about 1500.

* * * * *